US008590260B2

(12) United States Patent
Hamlin, III

(10) Patent No.: US 8,590,260 B2
(45) **Date of Patent: *Nov. 26, 2013**

(54) STRETCHED CABLE MEMBRANE ATTACHMENT SYSTEM

(76) Inventor: Henry Lee Hamlin, III, Macon, GA (US)

( * ) Notice: Subject to any disclaimer, the term of this patent is extended or adjusted under 35 U.S.C. 154(b) by 59 days.

This patent is subject to a terminal disclaimer.

(21) Appl. No.: 13/015,567

(22) Filed: Jan. 27, 2011

(65) Prior Publication Data

US 2011/0252740 A1 Oct. 20, 2011

Related U.S. Application Data

(63) Continuation-in-part of application No. 12/214,070, filed on Jun. 16, 2008, now abandoned, and a continuation-in-part of application No. 12/378,325, filed on Feb. 13, 2009, now Pat. No. 8,387,313, which is a continuation-in-part of application No. 12/214,070.

(60) Provisional application No. 61/298,606, filed on Jan. 27, 2010, provisional application No. 60/934,747, filed on Jun. 15, 2007.

(51) Int. Cl.
*E04B 1/00* (2006.01)

(52) U.S. Cl.
USPC ..... 52/741.3; 52/5; 52/23; 52/222; 52/410

(58) Field of Classification Search
USPC ..... 52/3–5, 23, 222, 408, 409, 410, 741.3, 52/741.4
See application file for complete search history.

(56) References Cited

U.S. PATENT DOCUMENTS

| | | | | |
|---|---|---|---|---|
| 1,871,101 | A * | 8/1932 | Waltz | 135/119 |
| 5,522,184 | A * | 6/1996 | Oviedo-Reyes | 52/23 |
| 5,623,788 | A * | 4/1997 | Bimberg et al. | 52/23 |
| 5,966,877 | A * | 10/1999 | Hawes | 52/63 |
| 2004/0045223 | A1 * | 3/2004 | Deskin | 52/3 |
| 2007/0193121 | A1 * | 8/2007 | Diaz et al. | 52/3 |

* cited by examiner

*Primary Examiner* — William Gilbert
(74) *Attorney, Agent, or Firm* — Brian D. Bellamy

(57) ABSTRACT

The system and method of securing a single ply membrane to a roof deck or structure described utilizes sections of cable or reinforced membrane material that are completely protected or surrounded by the single ply membrane. A set of perimeter cables or interior cables secure the membrane to a roof decking by stretching the cables or reinforced membrane sections until taut. The cables are secured at their endpoints and additional fasteners may be provided along their lengths. Membrane material is used to weatherproof the fastening of the cables to the roof decking.

20 Claims, 14 Drawing Sheets folded layers create elongate member to seam folded layers create elongate member to edge folded layers create elongate member heat and pressure fuse elongate to seam or edge of material edge of membrane intermediate seam Whole of body Core Section channel manufactured channel manufactured channel fold over heat sealed eyelets elongate eyelets Synthetic Polymers Added During Manufacture Added Within During Manufacture folded into overlapping welded/adhesive to edge welded/adhesive to seam welded into folding folding material over cord layering material over cord Roller Type anchor or combine with pully and rachet Heat seal end remove ratchet
add boot, cover w/
material

STRETCHED CABLE MEMBRANE ATTACHMENT SYSTEM

PRIORITY CLAIM

The present application claims benefit of U.S. Provisional Patent Application No. 61/298,606 filed on Jan. 27, 2010. Further, the present application claims benefit as a continuation in part of U.S. patent application Ser. No. 12/214,070 filed on Jun. 16, 2008 which further claims benefit of U.S. Provisional Application No. 60/934,747 filed on Jun. 15, 2007. The present application also claims benefit as a continuation in part of U.S. patent application Ser. No. 12/378,325 filed on Feb. 13, 2009 which is a continuation in part of and claims benefit of U.S. patent application Ser. No. 12/214/070 filed on Jun. 16, 2008.

FIELD OF THE INVENTION

The present invention relates to a method and system of installing roofing or waterproofing membrane, particularly installation whereby the membrane is secured with several reinforced elongate members such as cable and related fasteners.

BACKGROUND

A typical low slope roof consists of the following components, from bottom to top (not including structural components of the building): deck system, insulation, and a waterproof barrier. The perimeter of the roof may be flat, have a parapet wall, or a combination of both. In the main field of the body of the roof, there can be any number of roof penetrations and other items, including such features as plumbing vent pipes, HVAC units on curbs or supports, expansion joints, conduit, or a wide variety of other items.

Singly ply membranes are rapidly becoming the most popular roofing system for buildings with low slope roofs. Single ply membranes include such materials as thermoplastics (TPO, PVC, CPE, among others) and rubber roof membrane (EPDM). These materials typically are packaged in roll form and are unrolled onto the roof during installation. The sides and ends of the rolls are overlapped and then joined via some form of adhesion (heat or chemical means are the most common) to form a larger, continuous sheet. The rest of installation depends on the means of waterproofing at through-roof penetrations and other rooftop structures but also includes an especially important step—securing the roof to the building's structure.

There are three primary means of securing a roofing system to a building's structure: mechanical fastening, adhering, or ballasting. Mechanical fastening involves passing fasteners through the membrane and substrate then into the decking material. This method is most common for roofs that are easily screwed into, i.e. wood or metal decks. Adhering involves gluing the roof system to the decking and is most common for roofs where the decking is not easily mechanically fastened to, especially in the case of concrete decks. Ballasting involves placing a fairly large quantity of small rock or pebbles on the membrane's surface. This method of securing the roofing system to the building works great in situations where one might not want or be able to mechanically fasten or fully adhere the system to the roof. Each of these methods secures the roof system to the deck and structure of the building, and each one can be used in a wide variety of instances, depending on the particular building's needs.

The most common types of decking for low slope roofs are: metal, wood, and concrete. Metal decking is comprised of sheets of metal that have been bent into a specific pattern in order to better support the weight of the roof. Wood decking is typically either sheets or planks of wood. Concrete decking is typically fairly thick (over one or two inches in thickness) and is either poured in place or set in pre-fabricated pieces. Though all of these types of deck are capable of receiving mechanical fasteners, it is a very simple process in wood and metal decks, while it is more difficult and labor consuming in concrete decks. Fastening into wood or metal simply requires screwing or nailing into it. Fastening into concrete requires pre-drilling the hole and then inserting a separate fastening mechanism into or through the hole. This process which is much more labor intensive and time consuming when one considers the large quantity of fasteners that must be installed on a roof to properly secure it with necessary wind uplift ratings.

Both the options of either fully adhering a roof system or ballasting a roof system carry with them disadvantages. For instance, it is not always possible to fully adhere a membrane system to a roof due to moisture content within an existing roof system (in the case of re-roofing over the existing roof) or even due to the fumes from the adhesives. Ballasting the roof involves a large quantity of the rock in order to provide sufficient downward force to resist wind uplift. This rock must be moved to the roof during installation, requiring many truckloads for larger roofs. Also, if the roof leaks after installation by ballasting, the repair process is not nearly as straightforward as the roof is hidden underneath a thick layer of rock. Both adhering and ballasting are highly labor intensive methods of roof installation and require other special details in order to complete the roofing system.

Oftentimes, regardless of the type of deck, fully adhering or ballasting the roof both are undesirable. If the deck does not easily receive mechanical fasteners, one would ideally like an option to still mechanically fasten but with a lesser number of fasteners. There have been previous inventions that have attempted to solve this problem. One of interest would be U.S. Pat. No. 7,028,438, which is a roofing system that utilizes hold down straps for insulation. In addition, others have used batten bars, which help to further secure the roofing membrane in locations linearly between the main fasteners. U.S. Pat. No. 6,764,260 uses this method. These prior methods fail to sufficiently improve the process of mechanically fastening a roof.

SUMMARY OF THE INVENTION

The goal of this invention is improve the efficiency of mechanically fastening single ply membrane roofing systems, as well as to improve wind uplift resistance and durability of the roof system in general. The Stretched Cable Membrane Attachment System is designed around the idea of using a strong reinforced elongate member such as a cable to secure the roof membrane to the deck of the building. The elongate member would still require mechanical fastening or use of an attachment device about the perimeter of the roof decking, but the frequency of the fasteners themselves would be drastically reduced due to the elongate member providing additional holding strength between them. In turn, the job would require less labor and time to be properly installed. In addition, the means of installing the elongate member would require the member and its fasteners be secured underneath (and completely encased in some cases) a layer of membrane so as to prevent any possible leakage. Provisions are included for different methods to accomplish this.

Steel cable covered by folded membrane will obtain the desired method. Further such methods include reinforcing the edge and seam of the membrane by providing integral components, or multiple layers of elongate material along those edges and seams involved in securing the membranes to the roof decking. Such layers may include fibrous and synthetic materials. Such integral components may include elongate fibers, rope and cords of any selected strong material.

The elongate member is stretched and thereby tightened across the membrane. The means for attaching the elongate member across the membrane to the roof deck is determined in-part by the type of elongate member. The means for stretching the elongate member likewise provided in cooperation with the type of elongate member chosen and several alternatives are discussed herein according to various embodiments of the invention.

DETAILED DESCRIPTION OF THE INVENTION

With different embodiments serving different purposes and applications, this invention will be presented first in its preferred embodiment then alternate installations will be presented. In addition, installations will not necessarily be limited to installing this system exactly as described. Those skilled in the art will be able to apply the methods to particular roofing situations while still holding to the spirit of the invention.

Figure 1:
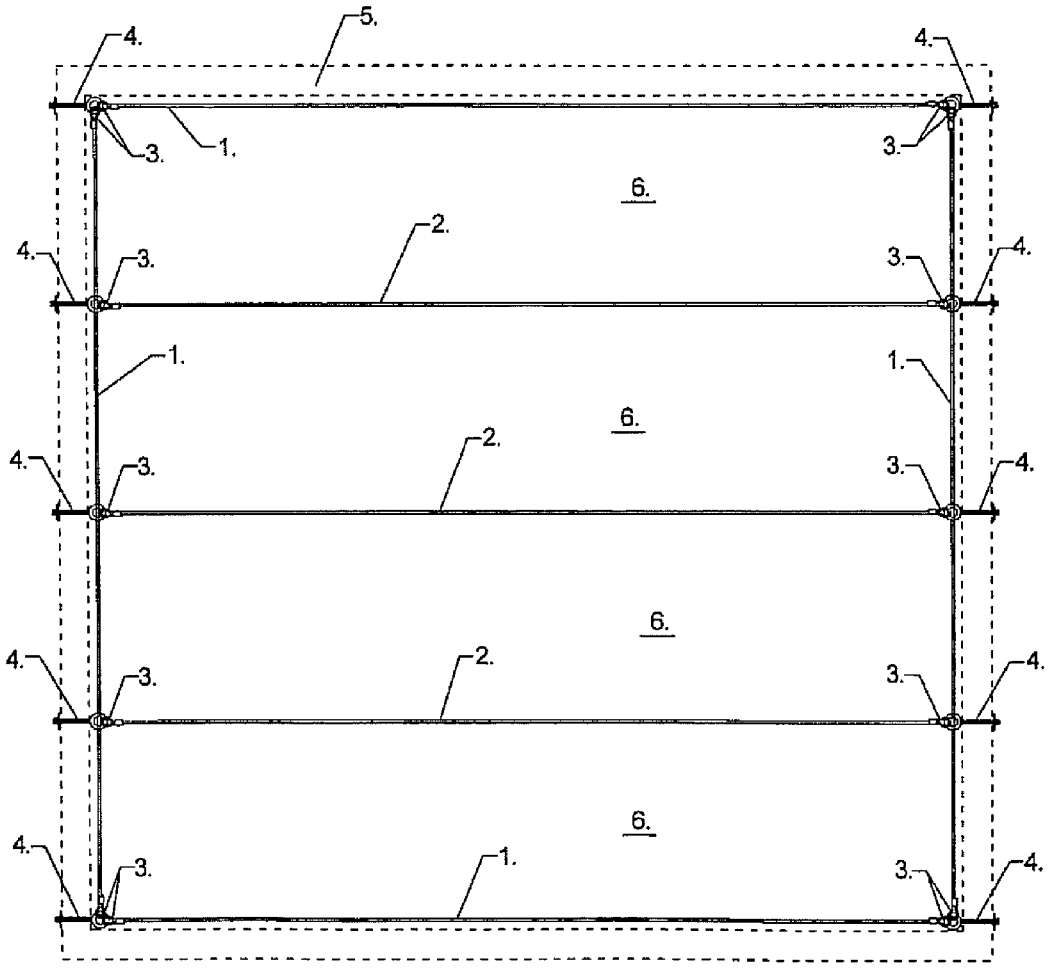
FIG. 1 is one embodiment of an overhead view of the surface of the roof with only the cable system showing (i.e. no membrane is depicted) in order to more clearly show the general layout. There is a plurality of wall fasteners (4.) fastened into opposite parapet walls (5.) and there are no wall fasteners (4.) in the parapet walls (5.) that are perpendicular to these. There are four perimeter cable sections (1.) that are connected to the wall fasteners (4.) at each of the four corners of the roof. There are three interior cables (2.) in the main roof area (6.) that are connected to wall fasteners (4.) on opposite parapet walls (5.). At each junction between cable section and wall fastener (4.), there is a cable termination (3.) where the endpoint of that particular section of cable is formed into a loop and crimped tightly to itself, forming a loop.

The stretched cable membrane attachment system, in its first embodiment of FIG. 1, consists of the following components: the perimeter cable sections 1 along with cable terminations 3, a single ply roofing membrane 11, a building that is in need of a roof, and wall fasteners 4 and decking attachment device 15 for securing the perimeter cable sections 1 or interior cables 2 and main field membrane. On a building on which the decking 8 and roof substrate 7 were already installed (substrate including all materials between the roofing membrane and the decking), one would begin by laying out the roofing membrane 11 onto the surface of the roof in the necessary pattern. The perimeter cable sections 1 would be installed at the perimeter of the building or section being roofed. Then, the interior cables 2 would be installed in the main field of the roof. The cables 1, 2 can be fabricated from a variety of materials with metal strands of wire being one embodiment.

Figure 2:
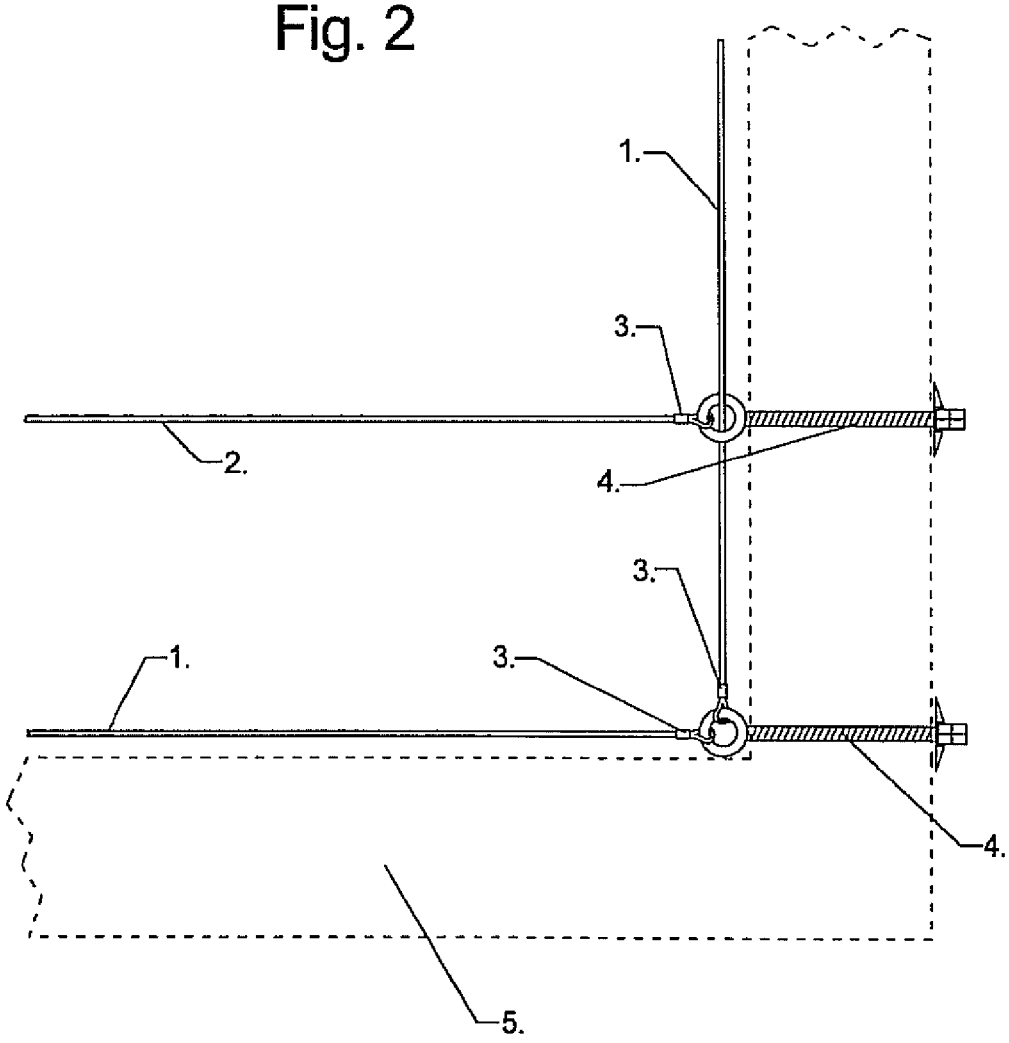
FIG. 2 is an enlarged view of the corner of the roof in the particular embodiment of the invention as shown in FIG. 1. There are two perimeter cable sections (1.) shown, joined in the corner via cable terminations (3.) at a wall fastener (4.) which is fastened through the parapet wall (5.). There is an additional wall fastener (4.), to which an interior cable (2.) is connected via a cable termination (3.).
Figure 6:
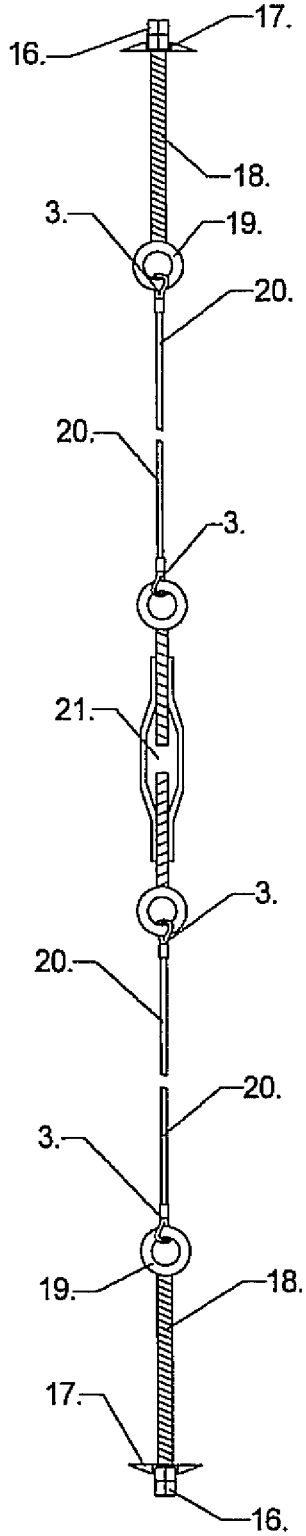
FIG. 6 is an enlarged fragmented view of an embodiment of a particular section of cable (either 1. or 2.). At each end of the assembly, there is one type of fastening device, consisting of a threaded shank (18.) and an eye (19.). On the distal end of the threaded shank (18.), there is a washer (17.) and a nut (16.), which is threaded onto the shank (18.) to secure the washer (17.), which is used to secure the eyebolt in the fastening position. To each eye (19.), there is a section of cable (20.) that is connected. There is a turn buckle (21.) situated roughly in the center of the assembly.

The first item to present will be the methods of fastening the cables 1, 2 to the roof, the building, or both. If a building has parapet walls 5 of sufficient height raised around the perimeter of the roof, the end of each cable 1, 2 can be fastened to a wall 5 on each end at an elevation close to the level of the roof using a wall fastener 4. This could consist of any variety of fasteners, with one possibility being an eyebolt as shown in FIGS. 2 and 6. The eyebolt could be placed such that the eye 19 is on the inside part of the wall and a bolt shank 18 is on the outside part as shown in FIG. 2. The shank 18 of FIG. 6 would then be secured with a washer 17 and a nut 16 such that the eyebolt is held firmly in place. At this point, the cable 1, 2 could be fastened to the eye 19, which typically consists of looping an end of the cable with a thimble in the loop and crimping the loop closed. The section of cable would then be stretched in the direction of the next fastening point, at which point it would be secured the same method.

Figure 3:
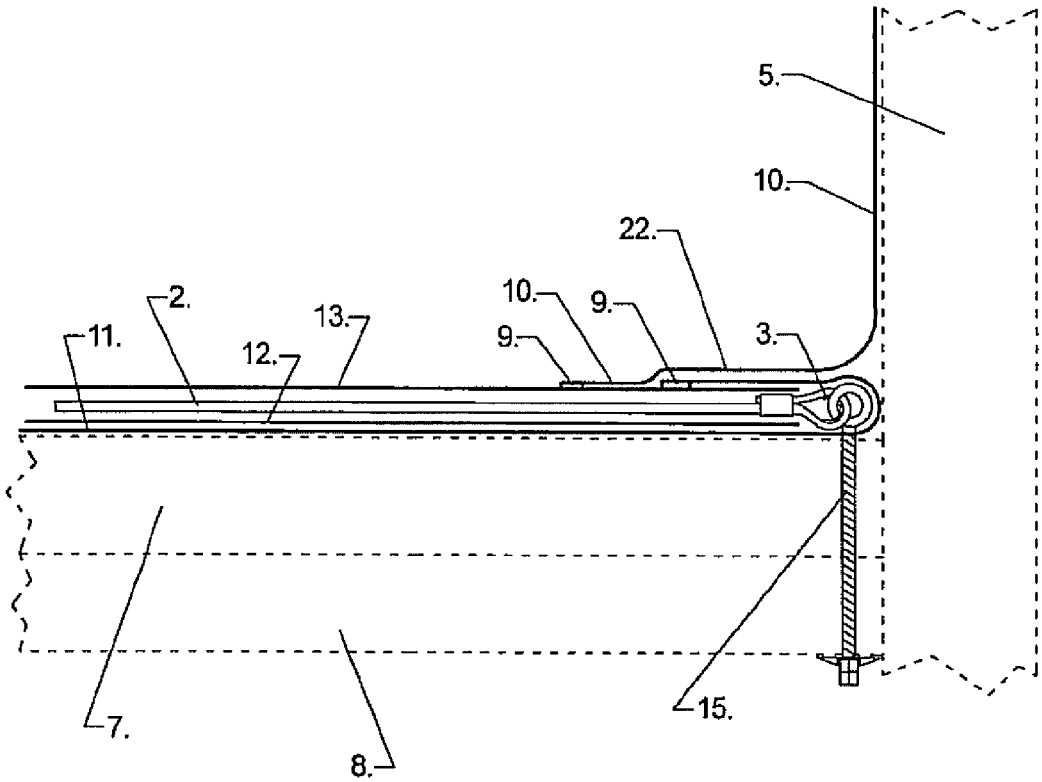
FIG. 3 is an embodiment of the invention showing a cutout view of an interior cable (2.) in its membrane encasement installed on a roof with a decking fastening device (15.) securing it. The cable (2.) is connected to the decking fastening device (15.) via the looped termination point (3.). The decking fastening device (15.) penetrates through the roof substrate (7.) and decking (8.). The field membrane (11.) is depicted beneath the membrane encasement assembly. The membrane encasement assembly consists of the lower strip of membrane (12.), which is beneath the cable (2.), and the upper strip of membrane (13.), which is situated over the cable (2.). The lower strip of membrane (12.) is heat welded or adhered to the field membrane (11.). The excess portion of the field membrane (22.) is then folded over the fastener (15.) and there is a heat weld (9.) between the excess membrane (22.) and the upper strip of the membrane encasement (13.). Then, in standard flashing methods, an addition layer of wall flashing membrane (10.) is adhered or fastened (method not depicted) to the parapet wall (5.) and then lays over the heat weld (9.) between the excess portion of the field membrane (22.) and the upper strip of the membrane encasement (13.). The wall flashing membrane (10.) is then welded to the upper strip of the membrane encasement (13.).
Figure 4:
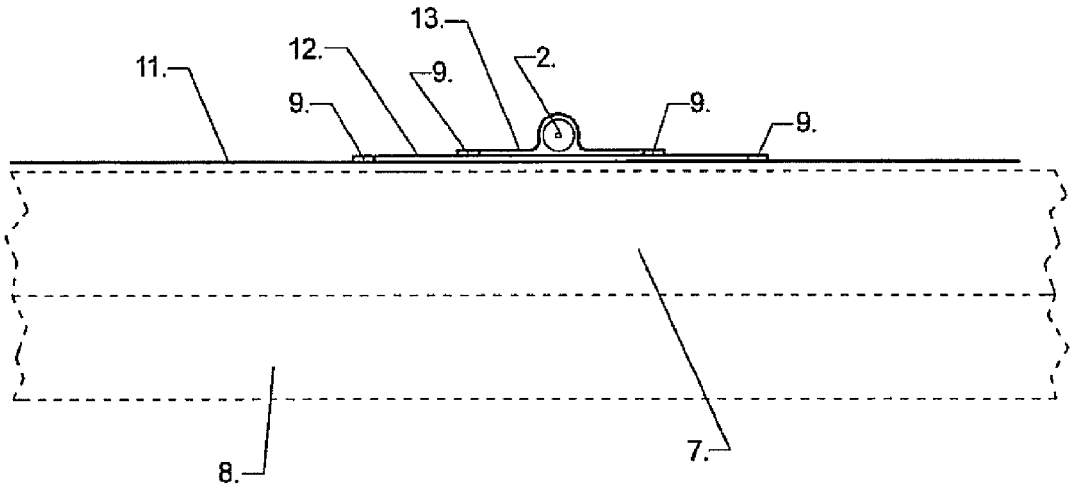
FIG. 4 is a cutout view of another embodiment of the membrane cable encasement. The roof substrate (7.) and decking (8.) are both shown with the main field membrane (11.) situated over them. The lower strip of the membrane encasement (12.) is then heat welded (9.) to the main field membrane (11.). The interior cable (2.) sits roughly midway on the lower strip of the membrane encasement (12.) and the upper strip of the membrane encasement (13.) is over the interior cable (2.) and is heat welded (9.) to the top surface of the lower strip of the membrane encasement (12.).
Figure 5:
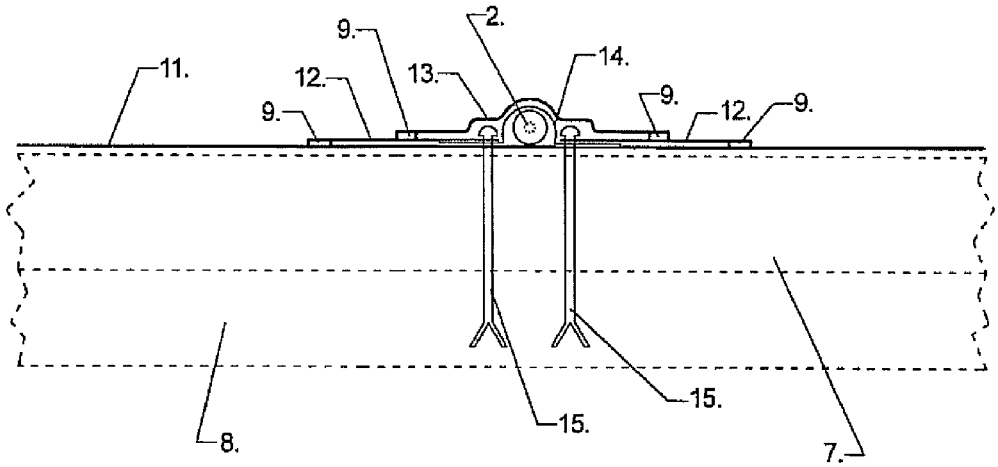
FIG. 5 is a cutout view of an embodiment of the membrane cable encasement with a cleat style fastener (14.) being used to secure the interior cable (2.) through the roof substrate (7.) and into the roof deck (8.) via one form of decking fastening devices (15.). The roof substrate (7.) and decking (8.) are both shown with the main field membrane (11.) situated over them. The lower strip of the membrane encasement (12.) is then heat welded (9.) to the main field membrane (11.). The interior cable (2.) sits roughly midway on the lower strip of the membrane encasement (12.) and the upper strip of the membrane encasement (13.) is over the interior cable (2.) and is heat welded (9.) to the top surface of the lower strip of the membrane encasement (12.). There is a hole cut in the lower strip of the membrane encasement (12.) such that the cleat style fastener (14.) can pass through it. However, the upper strip of the membrane encasement (13.) covers and waterproofs the penetrations.

This is only one of many means now disclosed for fastening the cable in accordance with the methods of the invention. Alternate ways would be to fasten the eyebolt or a similar decking fastening device 15 through the substrate 7 and decking 8 or even anchor it into the decking. A cleat style fastener 14 may be used in combination with the decking fastening device 15 to secure the cable to the deck with a u-shaped member as shown in FIG. 5. If a parapet wall is not present or is not suitable to receive a viable fastener, a fastener may be secured to the roofing decking 8 using alternative embodiments as shown in FIGS. 3-5.

The perimeter cable sections 1 consist of multiple lengths of cable that are each comparable in length to each side of the building's perimeter. The cable sections 1 would ideally be fastened such that the each section of cable runs parallel to each side of the perimeter of the building. It would then typically be fastened at any inside and outside corners that are encountered along this perimeter as shown in FIG. 1. At corners, each section of cable could have its own fastener, such as wall fasteners 4, at which it terminates or the end points of two separate cables could meet at the same fastening point as shown in FIG. 2. The interior cables 2 consist of a plurality of cables that are run across the interior main field membrane 11 of the area being roofed. The preferred method of running these cables is to run them all parallel to one another and parallel with the direction of the slope of the roof, such that water drainage will not be impeded by the presence of the cable. This method can be altered depending on the exact roofing situation.

In the preferred embodiment, each length of interior cable 2 will be fastened at or near to a perimeter edge of the building and then run in a direction perpendicular to the direction of the perimeter edge to which it is fastened. The interior cables 2 will be a regular distance apart, though this may vary depending on the quantity and positions of the roof penetrations and other features of the roof's surface. It may also be necessary that all cables do not run from one perimeter edge to another. If there is a large feature in the path of the cable that is run from one perimeter edge, the installer may choose to terminate the cable at the edge of the roof feature and then fasten it to the decking 8 at that location in the necessary manner. The distance apart for each section of cable will be determined by the roof requirements, paying particular attention to wind uplift requirements, the type of membrane 11 being used, and the method of fastening. A building with higher wind uplift requirements and a less rigorous method of fastening may require more interior cables 2, while one with low wind uplift requirements and a more rigorous method of fastening may require fewer interior cables. There may also be interior cables 2 used around through-roof penetrations to secure the roofing membrane 11 at the penetration's base. In this case, it would depend on the wind uplift requirements on whether the cable was fastened to the decking 8. With less rigorous needs, one may be able to avoid fastening to the deck around roof penetrations. It is also possible that one may terminate around the roof penetration in standard ways without using any sort of cable, though that is typically going to rely on the wind uplift requirements for the building, as well as the contractor's skills and the type of building and decking. In many cases, adhesive may even be used around the perimeter of the roof penetration in place of the cable.

There are several methods of installing the cable and incorporating it into the roof system. First, we will discuss the pre-fabricated cable encasement. In this case, each length of interior cable 2 will be pre-fabricated inside of a membrane encasement, preferably in advance and in a more controlled environment, though it can be done on site as well. This encasement consists of, from bottom to top: a lower strip of membrane 12, a length of cable, and an upper strip of membrane 13. The lower strip of membrane 12 would be made in lengths suitable for the end application on the roof as an interior cable 2. The interior cable would be situated roughly in the center of the lower membrane strip's width and would be of slightly longer length than the lower strip such that it would have sufficient available length at its ends to properly loop the cable and terminate it at the fastening points. The upper strip of membrane 13 would be of a length somewhat equal to the lower strip with a lesser width than the lower strip of membrane 12.

If using a membrane (such as thermoplastics) that is capable of being heat welded together, one could fabricate the cable encasement in the following manner. First, one would measure the length of the interior cables 2 that are needed. The lower strip of membrane 12 would be cut so that it was of a length that would conform to the distance between the two fastening points, most likely equal to the distance between two parapet walls 5 or two opposite perimeter edges of the building. The interior cable 2 would then be placed on top of the lower strip of membrane 12 and situated such that it was roughly centered along the width and length of the lower strip of membrane. The upper strip of membrane 13 would be cut so that it was a length close to that of the lower strip. This upper strip of membrane 13 would be placed such that it was centered about the width of the lower strip of membrane 12 and cable and its endpoints matched closely to the endpoints of the lower strip of membrane. The width of both strips of membrane would be greater in dimension than the cable's diameter such that the cable 2 could be encased within the two of them. The bottom surfaces of the edges of the upper strip of membrane 13 that run along the longer ends would then be adhered via a heat weld 9 to the upper surfaces of the lower strip of membrane 12. The end result would be that the two strips of membrane would form an encasement around the cable as shown in FIGS. 4 and 5, with the exception that the ends of the cable emerged from the open ends of the membrane encasement.

It is also possible to bypass the pre-fabrication step for this cable encasement and fabricate the encasement in the field or on the roof itself. One can also make the encasement in a variety of ways, all of which will result in the cable being encased in membrane strips 12, 13 aside from the ends, which emerge from the distal open ends of the encasement. One alternate method would be to first heat weld a strip of membrane to the main roof membrane where the interior cable 2 will be installed. Then, the cable will be installed and a wider strip of membrane will be installed of the cable and the lower strip by heat welding the upper strip of membrane to the main roof membrane. Therefore, either the upper strip of membrane 12 or lower strip of membrane 13 can be larger. Differences also arise in the way that one installs the cable encasement to the main field roof membrane 11. It is preferable to have an additional layer of membrane between the cable and the main roof membrane. This prevents the cable from rubbing through the main roof membrane and causing problems if there is too much movement. However, with the thickness of the membrane and the tightness of the cable, this extra precautionary layer of membrane is not always necessary. Alternately, one can install the cable directly over the main field membrane 11 then install a strip of membrane over the cable by heat welding the sides of the strip on each side of the cable to the main roof membrane. This serves to secure the cable to the roof itself in the areas between where the fasteners secure the roof and cable to the decking, thereby providing reinforcing hold down strength throughout the entire length of the cable.

The preferred method of installation of the entire roof system would be to first lay the main field membrane 11 on the substrate 7 and heat weld all seams. If seams are not capable of being heat welded, seams can also be adhered or glued as needed. Any cutting for penetrations would also be done during this process. This will effectively form a single piece of main field membrane 11, loose laid on the roof substrate 7, and ready to be fastened and flashed. There should also be excess membrane 22 at the perimeters such that the cable terminations 3 can be encased as in FIG. 3 and shielded from the elements. One can then begin installing the perimeter cable sections 2, situated such that the perimeter cable section sits over but flush with the membrane 11 along all perimeters of the building. This helps to ensure that the membrane will be held secure and close to the roof decking 8 such that it secures the membrane 11 to the deck even between wall fasteners 4 or decking fasteners 15. Again, these fasteners may reside in parapet walls, outer walls, or within or through the decking itself. These cables will then be fastened at the ends and tightened.

It is also possible to install turn buckles 21 in the lengths of a cable 20 to provide sufficient tension beyond what one is capable of with merely pulling the cable taut. The separate sections of cable 20 will attach to the eye 19 of wall fasteners 4 or decking fastening device 15, such as eyebolts with cable terminations 3 so that the turn buckle can be used to adjust tension. The combination forms a tight interior cable 2.

It is also suggested that, if one is using a fastener like an eyebolt, that one secure these prior to installing the perimeter cable sections 1. Where the perimeter cable section 1 would intersect the interior cable eyebolt, one could pass the perimeter cable section through the eye 19 of the eyebolt. This would permit the perimeter cable sections 1 to be at nearly the same elevation as the interior cables 2.

Once the perimeter cable sections 1 are fastened and secured in place, one can begin installation of the interior cables 2. Again, it is often more convenient to pre-install the fasteners, especially if one is intending to keep the interior cables 2 at more exact distances apart. Once the fasteners are installed at the necessary distances apart, one will normally begin installing cable between each pair of fasteners. Ideally, these interior cables 2 should all be run parallel to one another, but special situations may occur whereby cables may need to be crossed or at different angles.

The excess membrane 22 that overlaps the area of the roof should then be used to encase the perimeter cable sections 1 and protect them from the weather and elements. One would take the excess field membrane where it reaches beyond the extent of the perimeter cable and fold it over the perimeter cable in the direction of the main roof membrane as in FIG. 3. Then, the excess membrane would be welded or adhered to the main roof membrane 2, thus surrounding the cable in membrane material except where the interior cables 2 are fastened to their fasteners. There will likely be places, such as where the interior cable fasteners are placed, where the membrane may have to be cut to allow for the excess membrane to fold over. Once this process is complete, standard wall or perimeter flashing methods can be done, typically whereby an additional layer of membrane can be taken and welded or adhered to the main roof membrane further interior to the roof than where the excess membrane is welded. The opposite end can then be secured to the wall or outer perimeter of the building and terminated in the usual manner.

It is also possible to secure the cable within the membrane by placing the cable prior to heat welding the roof membrane seams. One could place the cable along one of the longer sides of a roll of membrane then fold that side over in the opposite direction such that it covers the cable, then heat weld it to itself such that the cable is encased in a tubular section of membrane. Then, one would place the next roll of roofing membrane such that it overlapped past the location of the heat weld on the previous roll of membrane. The side of this next roll would then weld to the first roll of membrane such that the cable had even more protection inside of its first membrane encasement.

For larger buildings or higher wind uplift ratings, it is often necessary to fasten the same pieces of cable in locations other than at the perimeters of the buildings, regardless of the cables running through the interior sections of the roof. In these situations, one would prefer to provide additional fasteners to the individual sections of the interior or perimeter cables. This fastening would be done in methods appropriate to the substrate and would be done in distances that would lead to sufficient hold down strength. In most buildings with concrete decking systems, the deck consists of a plurality of concrete panels, all of which are of similar sizes. One possible option for fastening in these types of decking systems would be to drill through the material which lies between the concrete panels, typically a filler material. One could then place an eyebolt through this hole with the eye above the roof and membrane and the bolt end protruding into the building itself. On the bolt end, one could place a washer that was larger than the gap between the concrete panels and then place a nut to secure the washer with sufficient tightness.

In any of these cases, the fastener that is located within the length of the cable (i.e. not at the endpoints) and should not in any case penetrate the upper strip of membrane which encases and waterproofs it. It is especially beneficial to not pre-fabricate the cable encasement in order to avoid this happening. Then, one is able to fasten the cable at some point along its length other than its endpoints and then the upper strip of membrane is welded over the cable and the lower strip, thus sealing the cable and any holes due to fastener penetration from the weather and elements.

Once the entire roof system is installed and secured with the cable system, standard flashing methods can be employed to completely waterproof the building. The end result should, in all cases, be that the cable is not exposed in any location to the elements. It should be encased on all sides by any of the following: roof substrate or decking, parapet walls, roofing membrane, or other parts of the building's structure. The complete encasement of the cable is not only what brings strength to the system's wind uplift capabilities, but also what protects it and permits it to last long term under a high tension.

In addition to using cable as a strong elongate member, additional embodiments provide alternatives that may be desired in application of the invention. In particular, the elongate member may comprise a reinforced edge or seam of the membrane. This could eliminate steel cable as a separate component of the stretched cable membrane attachment system, while also providing for greater flexibility and improved attachment systems for securing the elongate member to the roof decking 8. The reinforced portions providing the elongate members may be situated in the membrane for attachment at every bar joist or joists may be skipped according to engineering specifications that are balanced between the desire to secure the roof membrane while minimizing labor and materials for installation. These reinforced elongate members within the membrane will provide the added tinsel strength needed to stretch the elongate member and tie-down the membrane using such elongate member portion. The elongate member portions of the membrane may be incorporated through the process of manufacturing the membrane material or through adding external reinforcement material into the membrane after manufacture.

Figure 7:
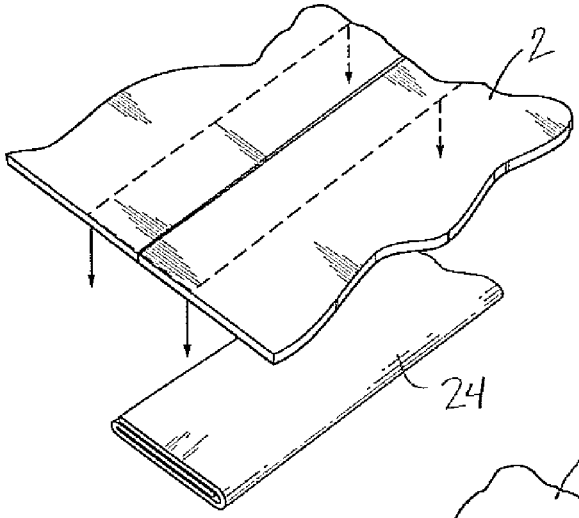
FIG. 7 is a partial perspective view of an elongate reinforced cable seam formed by folded layers in accordance with an embodiment of the invention.
Figure 8:
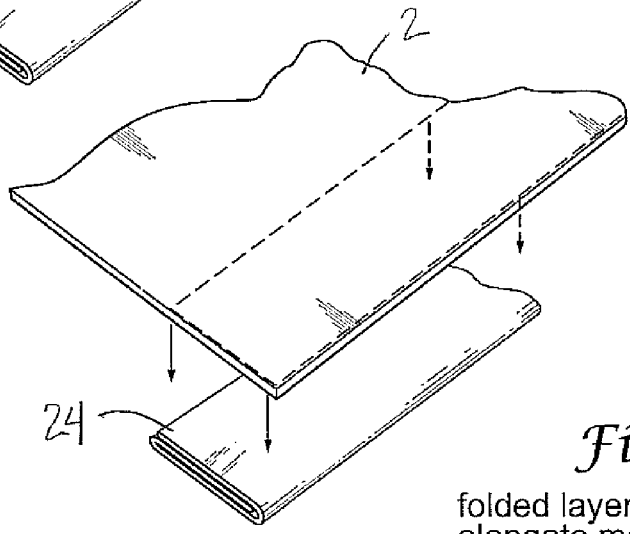
FIG. 8 is a partial perspective view of an elongate reinforced cable seam formed by folded layers in accordance with an additional embodiment of the invention.
Figure 9A:
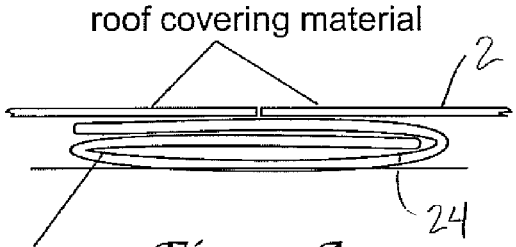
FIG. 9A is an end view of an elongate reinforced cable seam created by folded layers of material and covered by roofing membrane.
Figure 9B:
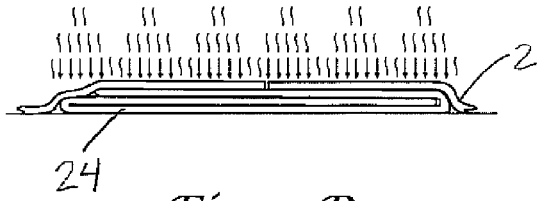
FIG. 9B is an end view of an elongate reinforced cable seam created by folded layers of material and covered by roofing membrane material that is welded to the cable seam.

In one method contemplated, multiple layers of membrane material are provided in an elongate section of membrane to reinforce that membrane at the particular edge or seam that is layered as shown in FIGS. 7-8. The multiple layers 24 of material may be provided on the membrane structure by folding the membrane onto itself or laying cut strips of membrane as in FIG. 9A. Such layers 24 of membrane material are situated at the edge or seams and bonded through lamination, glue, welding means as shown in FIG. 9B or mechanical means such as rivets or tie-down bolts. These means of securing the reinforced elongate member structure may be combined and arranged to provide a unique structure to the elongate member such as having a flat profile to minimize protrusion.

Figure 10A:
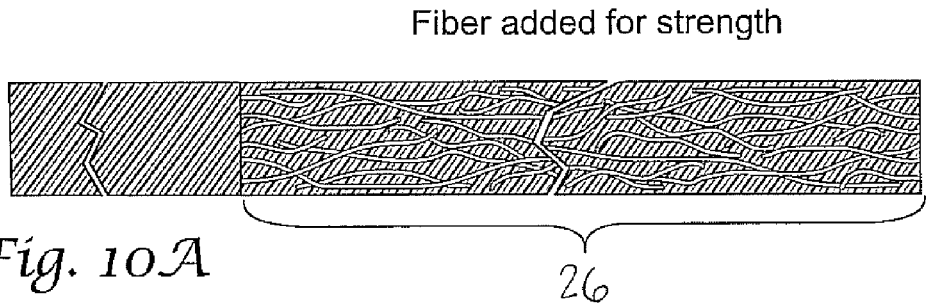
FIG. 10A is sectional schematic view illustrating a portion of cable seam reinforced by fiber in which the fiber is added to an edge of a membrane material forming the seam.
Figure 10B:
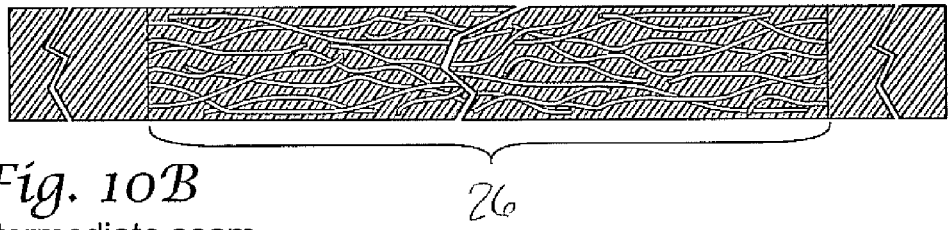
FIG. 10B is sectional schematic view illustrating a portion of cable seam reinforced by fiber in which the fiber is added to an intermediate section of a membrane material forming the seam.
Figure 10C:
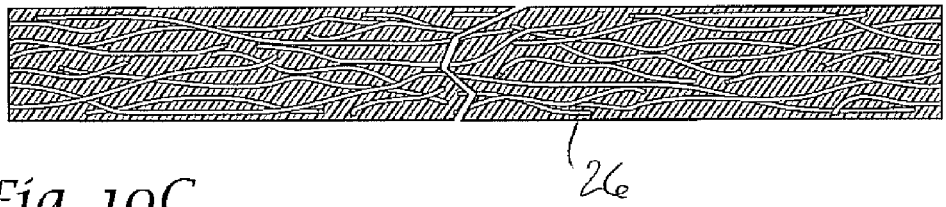
FIG. 10C is sectional schematic view illustrating a portion of cable seam reinforced by fiber in which the fiber is added to the entire body of the membrane material forming the seam.
Figure 10D:
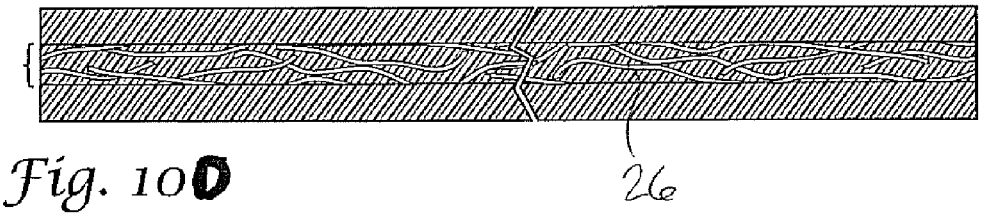
FIG. 10D is sectional schematic view illustrating a portion of cable seam reinforced by fiber in which the fiber is added to a core section within a membrane material forming the seam.

An elongate reinforced member having a flat profile will increase the thickness of the membrane in that portion for added strength. The reinforced portion may include as an addition or as a substitute for multiple layers of membrane material other high-strength components as shown in FIGS. 10A-10D and 12A-12F. First, the chemical structure of the membrane may be varied to change the characteristic and strength of the elongate member that will tighten in an elongate crossing manner to attach the membrane. In another embodiment, high strength fibers 26 are incorporated in the structure of the membrane edge as in FIG. 10A or intermediate seam as in FIG. 10B. Such fibers 26 may be a part of the elongate member as a whole of the body, seen in FIG. 10C, or engineered as a core sectional component of the elongate member for added strength, as seen in FIG. 10D.

Figure 11A:
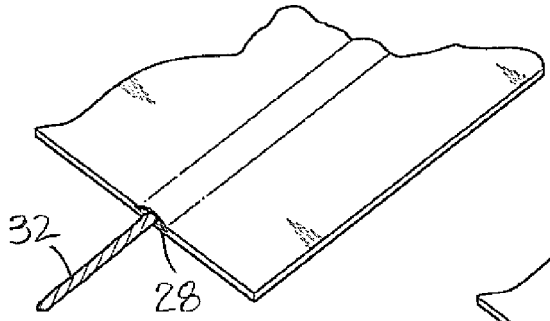
FIG. 11A is a partial perspective view of a cable seam formed by inserting cable through a channel manufactured within a roofing membrane material.
Figure 11B:
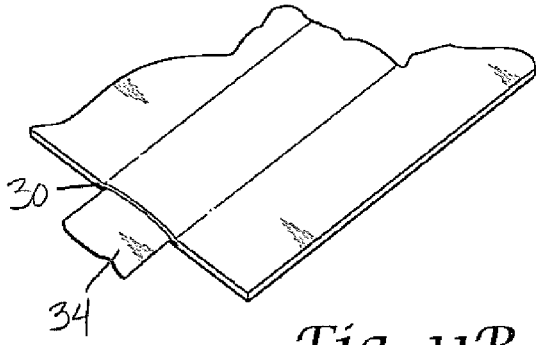
FIG. 11B is a partial perspective view of a cable seam formed by inserting a reinforced material, such as fiber reinforced membrane, through a channel manufactured within a roofing membrane material.
Figure 11C:
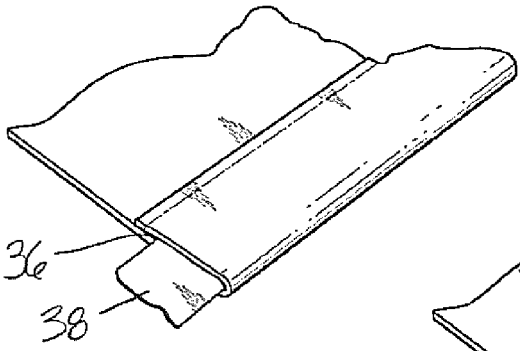
FIG. 11C is a partial perspective view of a cable seam formed by folding a membrane edge over a reinforced material to form a reinforced seam material.
Figure 11D:
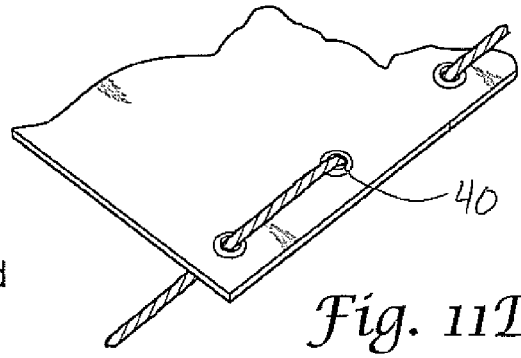
FIG. 11D is a partial perspective view of a cable seam formed by inserting cable through eyelets within a roofing membrane material.
Figure 11E:
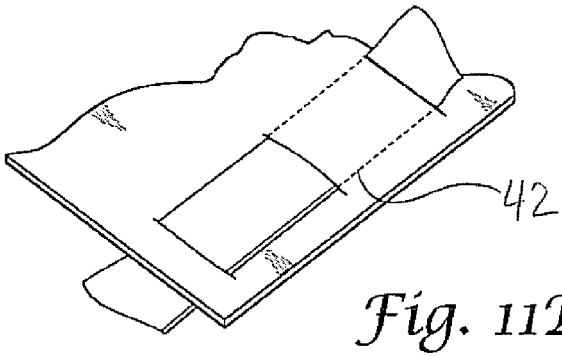
FIG. 11E is a partial perspective view of a cable seam formed by inserting a reinforced material, such as fiber reinforced membrane, through elongate eyelets formed within a roofing membrane material, such as by a plurality of slits in the membrane.
Figure 12A:
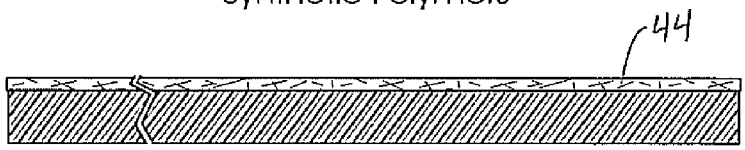
FIG. 12A is a partial end view of a reinforced membrane seam formed by adding synthetic reinforced material to the top of roofing membrane material during manufacture of the roofing membrane.
Figure 12B:
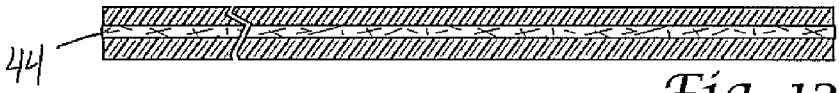
FIG. 12B is a partial end view of a reinforced membrane seam formed by adding synthetic reinforced material between portions of roofing membrane material during manufacture of the roofing membrane.
Figure 12C:
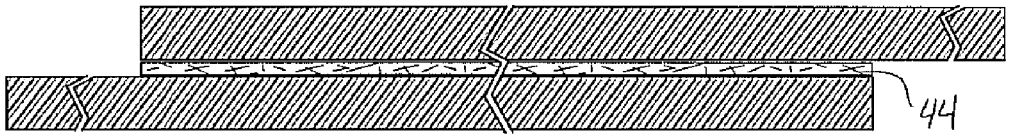
FIG. 12C is a partial end view of a reinforced membrane seam formed by adding synthetic reinforced material between portions of overlapping roofing membrane material.
Figure 12D:
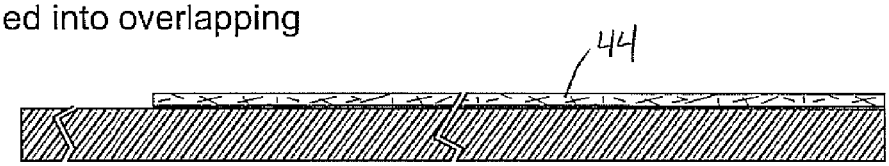
FIG. 12D is a partial end view of a reinforced membrane seam formed by welding synthetic reinforced material to an edge of roofing membrane material.
Figure 12E:
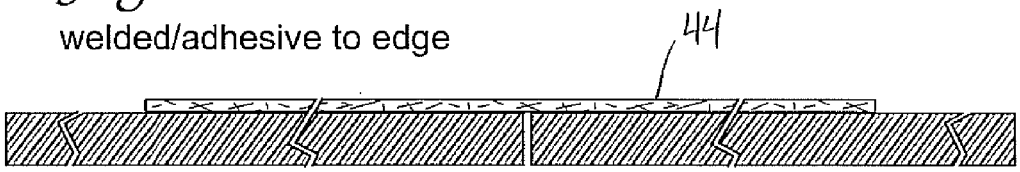
FIG. 12E is a partial end view of a reinforced membrane seam formed by welding synthetic reinforced material to the top of roofing membrane material while covering the seam between abutting membrane portions.
Figure 12F:
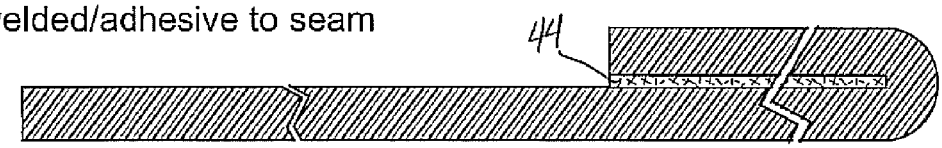
FIG. 12F is a partial end view of a reinforced membrane seam formed by folding and welding a portion of membrane material over a synthetic reinforced material.

During manufacture or by steps taken thereafter, a core material 32, 34 may be added through a tubular section or channel 28, 30 within a modified membrane 30 as in FIGS. 11A-11B. Alternatively, the tube or channel 36 may be arranged by folding the membrane over an inserted core material 38 as in FIG. 11C or by providing eyelets 40 (FIG. 11D) or elongate opening 42 in membrane by other means such as manufacturing insertions (FIG. 11E). In addition to fibers 26, the reinforcement material may include synthetic polymers 44 shown in FIGS. 12A-12F added during manufacture (FIG. 12A) or molded within the membrane (FIG. 12B), or folded into overlapping sections of membrane material after manufacture of the membrane (FIG. 12C), including elongate portions of material such as polyester. Such synthetic material may also be bonded to the edge or seam of the membrane by welding, adhesive or mechanical means as in FIGS. 12D-12F.

Figure 13A:
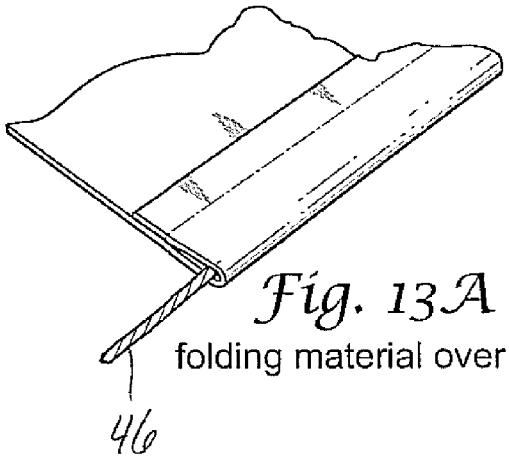
FIG. 13A is a partial perspective view of a cable seam formed by folding a portion of membrane material over a cord and welding the membrane material to attach the cord.
Figure 13B:
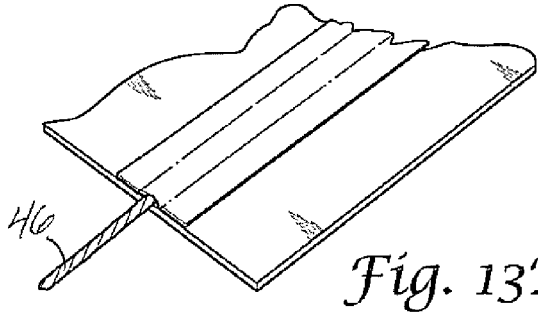
FIG. 13B is a partial perspective view of a cable seam formed by layering a portion of membrane material over a cord and welding the membrane material to attach the cord.
Figure 14:
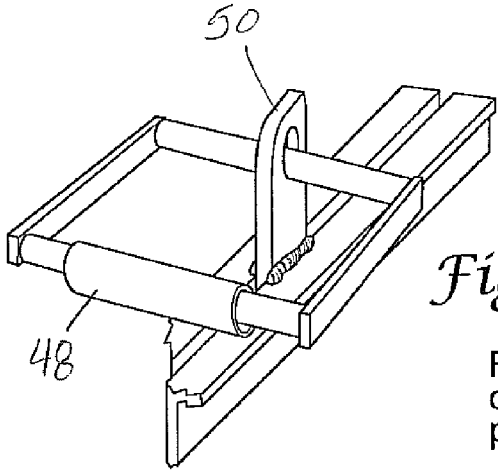
FIG. 14 is a perspective view of a roller for anchoring a reinforced section of membrane material.

As discussed with respect to cable, the strong elongate member may be provided separately from the membrane for securing the membrane to the roof deck. While cable 1, 2 is a preferred embodiment, it is now recognized that other alternative embodiments provide corded reinforcement means comprised of fibers or other elongate material and forming one or more cords of material such as rope that may be used in the methods of the invention. One or more of the cords are incorporated onto the length of the desired edge or seam of the membrane material and secured thereto. More than one cord may be used together according to the type of cord, strength, spacing, and features desired. Like cables, the corded material could be connected by eyebolts, rollers or brackets and waterproofed with a covering of excess membrane material, for instance as shown in FIGS. 13A-13B. Corded material 46 may be secured to the membrane by folding the membrane material back over the cord (FIG. 13A), by bonding the cord to the membrane with adhesion or welding, or by layering membrane material over the cord 46 (FIG. 13B). The cord material may be specially treated and engineered to bond to the membrane material and improve the function of the cord material in stretching across, attaching and securing the roof membrane material. The cord material may also be provided treated surfaces to prevent damage and tearing of the membrane material.

Figure 15A:
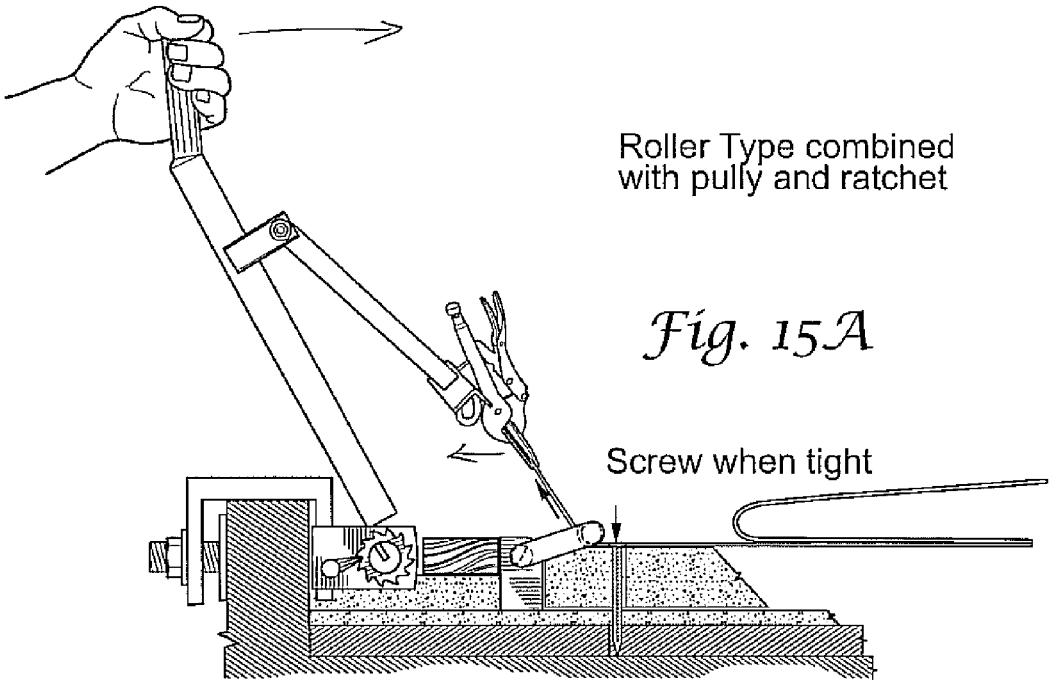
FIG. 15A is a side view of a roller combined with pulley for anchoring a reinforced section of membrane material. An alternative ratchet is also shown, but not in use.
Figure 15B:
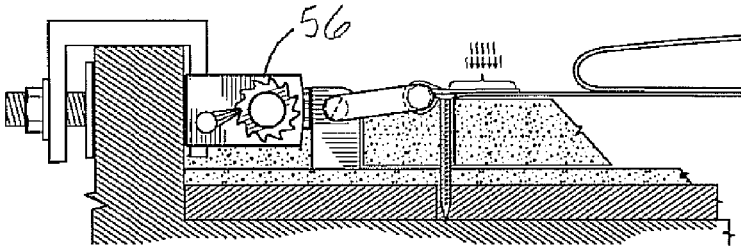
FIG. 15B is a side view of a reinforced membrane attached by tightening, overlapping, and welding.

Attachment device means is provided for attaching and tightening the membrane material when such material is provided a reinforced edge. A first attachment device for tightening the membrane material is insertion of a roller 48 near the reinforced edge as seen in FIG. 14 and FIGS. 15A-15C. The reinforced seam of the membrane may be pulled tight using a removable lever arm 52 as shown in FIG. 15A. After the membrane is tight, the lever arm 52 may be removed for sealing and waterproofing. The roller 48 allows the membrane material to pull and stretch tight by rolling against the membrane surface and may be arranged to lap the membrane material back over itself as in FIG. 15B for covering the reinforced edge and the elongate member therein. The overlapped portion can be bonded to the membrane to seal the roller 48 within the membrane material for permanent fixture and weatherproofing. Once the membrane material is tight, a recessed adjustment screw inserted within the reinforced membrane portion may secure the roller and hence the material in the tightened form. The elongate roller is secured on the opposing ends by a elongate shaft there through or by bearing pins inserted in each end that allow the roller to rotate.

Figure 15C:
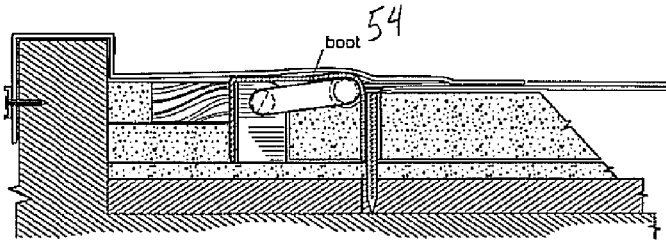
FIG. 15C is a side view of a reinforced membrane attached by tightening, removing tightening tools, covering, and welding to attach.

The roller 48 is secured to the roof by mounting the brackets for holding the shaft or pins downward to the roof deck or horizontally sideways to the peripheral wall of the roof. The type of bracket 50 shown in FIG. 14 may be recessed and may be received by a cable in lieu of a roller, whereby a cable is inserted through the eye of the bracket as an attachment device and tightened using methods discussed herein. In particular, the recessed bracket may hold the cable while tightened and provide an anchor for the tightened cable when affixed using a cable clamp that joins an overlapping excess portion of cable to the taut cable line. Such recessed bracket or roller may be covered and sealed within a welded section of membrane material as shown in FIG. 15C, thus forming a boot 54 covering the mechanical apparatus for tightening the membrane material. The recessed and weather-sealed bracket may also include a ratchet 56 fastened to the concrete decking of the roof for tightening the cable as in the alternative embodiment of FIG. 16B.

Figures 16A, 16B, 17A, 17B:
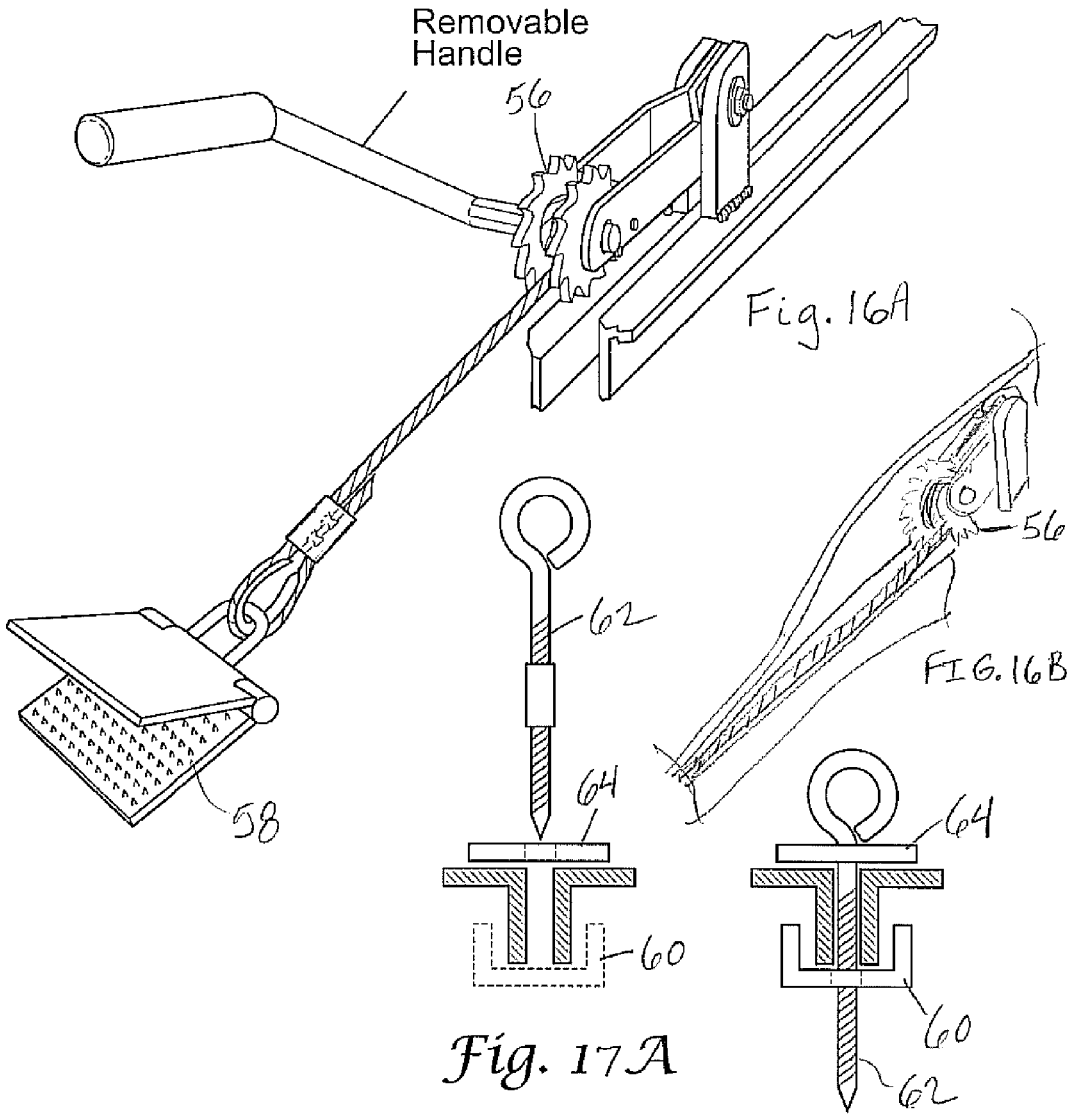
FIG. 16A is a perspective view illustrating an embodiment of the invention that includes a ratchet with removable handle for tightening a reinforced seam or cable, wherein the seam material is attached indirectly through a clamp and tightened using the ratchet.
FIG. 16B is a perspective view of an embodiment including a ratchet wherein the seam material is attached directly to the ratchet.
FIGS. 17A and 17B illustrate is a side cut-away view of a roof beam with bracket for attaching an eyelet for supporting a tightened cable.

As mentioned, alternatively as a means for tightening, a ratchet 56 is attached to the roof deck or peripheral wall of the roof and acts as an attachment device that stretches the membrane material as shown in FIGS. 16A-16B. This method has been found particularly useful when working with concrete decking. The ratchet 56 attaches to the membrane about the reinforced edge and elongate member and the ratchet helps hold down the membrane at the edge thereof. Special measures are considered for reinforcement of the holding edge between the ratchet and the elongate member of the membrane edge. A clamp 58 or friction is used to attach the ratchet to the membrane edge. Such ratchet is also combined with a pulley and attached to the reinforced membrane edge or alternatively the elongate member, such as cable or cord, for pulling and tightening either the membrane or the elongate member. The ratchet and pulley combination may be mounted to the wall of the roof, the roof deck, or to a substructure bar joist of the roof. The ratchet is attached to a bar joist in one example by inserting a bracket between the bar joist and turning the bracket to secure the bracket below the bar joist using a bolt that secures the ratchet and pulley. Once installed, the ratchet and pulley may be covered by the boot 54 to protect the device from nature's elements and to improve the aesthetics of a finished roof.

The elongate member, whether cable, cord or reinforced edge is secured to the roof deck or to underlying joists. Attachment may be accomplished by using a bolt or screw to attach to the roof deck and providing an eyelet on the top end of the bolt or screw to hold the elongate member. When using a bolt or screw, an opposing bracket 60 may hold the bolt or screw to the joist. In a method for insertion of the bracket, the bracket is turned sideways to fit between spatially separated adjacent joists. The bracket is lowered beneath the joists and turned to engage the bottom sides of the joists as shown in FIG. 17A. The bracket includes edge flanges for engaging the bottom sides of the joists and retaining the bracket thereon when the bolt or screw is tightened as in FIG. 17B. The bolt 62 may include an opposing nut on the opposing side of the bracket, or a screw type bolt may be provided with a self-tapping tip that taps the surface of the bracket. The bolt or screw means is alternately incorporated into the reinforced edge or seam as a molded seam plate 64 within the membrane and provided an integrated adjustment screw. The molded seam plate is attached like the bolt or screw directly to the deck or by means for attachment to underlying joists. Such means may include the bracket anchor for insertion between joists.

Figure 18A:
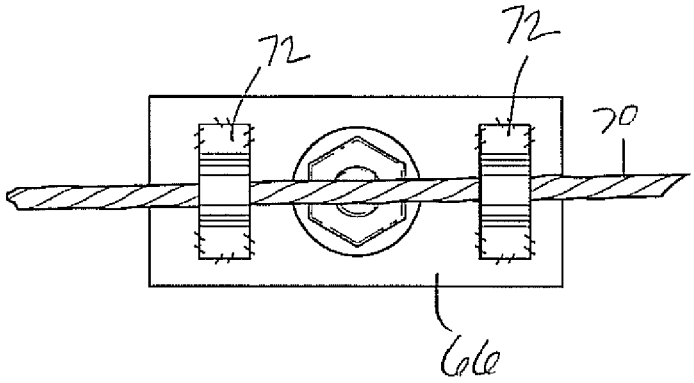
FIG. 18A is a top view of an alternative embodiment of a clamping or eyelet member for supporting a tightened cable attached to a roof beam.
Figure 18B:
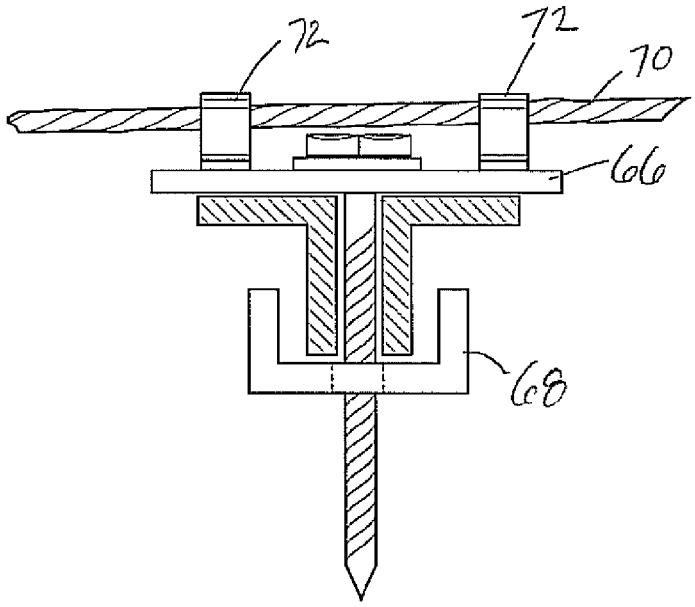
FIG. 18B is a side cut-away view of a clamping or eyelet member for supporting a tightened cable attached to a roof beam.

In another attachment means, the elongate member is secured to the roof by a recessed clamp 66. The clamps may be secured to the roof deck or secured to bar joists by opposing bracket anchors 68 shown in FIG. 18B. The clamp is inserted into the reinforced edge or seam or provided in combination with a cable or cord 70 to pass through eyelets 72 or U-brackets affixed to the clamp. The clamp includes a top panel member that bears against the membrane and clamps the membrane to the roof. A series of clamps are spaced along the edge or seam of the membrane about every 40 linear feet in typical applications. The clamps are connected by the reinforced edge or seam or by the passage of a cable or cord through the u-brackets. The clamps are protected and sealed within the edge or seam by covering with membrane material and could be incorporated during manufacture of the membrane.

The elongate member may be tightened and secured to the roof by clamp or friction means at the ends of the elongate members as with the device shown in FIG. 16A. This will be efficient in particular for elongate members that comprise a reinforced edge or seam of membrane material. Panels of the clamp 58 to be situated on opposing sides of the membrane have a friction increasing surface and act as grabbing members. The surface of the grabbing members may include teeth or spikes for grabbing the elongate member ends. These grabbing members are pressed against the elongate member ends for engaging them. A hinged bar shank attached to the grabbing members forces them together and can be locked for holding, or the grabbing members can be brought together for holding by passage of bolts or screws through them and tightening said bolts or screws.

Several additional steps are contemplated during installation of a cable secured roof membrane. These include using a wood strip nailed to the membrane at the edge may improve installation of the membrane. The wood strip may secure the membrane temporarily while installing the cable or attaching the reinforced membrane edge to the rood deck or bar joists. During installation of the membrane, a drip edge is inserted, if needed, beneath the edge of the membrane and may comprise a T-arm bar.

I claim:

1. A method for installation of membrane material on a roof comprising the steps of:

a. covering a roof decking with a membrane material, the membrane material covering a roof substrate to the perimeters of the roof decking;
b. providing a plurality of elongate members;
c. placing the plurality of elongate members in spaced relation across the membrane material;
d. stretching the elongate members taut to retain membrane material and secure the membrane material between the elongate members and the roof substrate;
e. affixing the elongate members by an attachment device about the perimeter of the roof decking while in said taut condition across the membrane material;
f. covering the elongate members and the attachment device with additional membrane material for weatherproofing; and
g. applying flashing about the perimeter of the membrane material to aid in waterproofing a building.

2. A method for installation of membrane material on a roof as in claim 1 in which said step of affixing the elongate members includes securing the elongate members to underlying joists of the roof decking.

3. A method for installation of membrane material on a roof comprising the steps of:

a. covering a roof decking with a membrane material, the membrane material covering a roof substrate to the perimeters of the roof decking;
b. providing a plurality of elongate members;
c. reinforcing said plurality of elongate members and providing a tinsel strength sufficient to stretch the elongate members and tie-down the membrane material;
d. placing the plurality of elongate members in spaced relation across the membrane material;
e. stretching the elongate members taut to retain the membrane material and secure the membrane material between the elongate members and the roof substrate;
f. affixing the elongate members by an attachment device about the perimeter of the roof decking while in said taut condition across the membrane material; and
g. applying flashing about the perimeter of the membrane material to aid in waterproofing a building.

4. A method for installation of membrane material on a roof as in claim 3 in which said step of reinforcing said plurality of elongate members includes providing an elongate member comprising a reinforced edge or seam of the membrane material.

5. A method for installation of membrane material on a roof as in claim 4 in which the reinforced edge or seam of the membrane material is reinforced by layering multiple layers of the membrane material along the reinforced edge or seam and bonding the multiple layers of the membrane material together or attaching the multiple layers of the membrane material together by mechanical means.

6. A method for installation of membrane material on a roof as in claim 4 in which the layering of multiple layers of the membrane material includes the step of folding the membrane material onto itself or placing cut strips of the membrane material along the reinforced edge or seam thereof.

7. A method for installation of membrane material on a roof as in claim 3 in which said step of reinforcing said plurality of elongate members includes providing a reinforced portion of membrane material reinforced by modifying the chemical structure of the reinforced portion of the membrane material.

8. A method for installation of membrane material on a roof as in claim 3 in which said step of reinforcing said plurality of elongate members includes providing a reinforced portion of membrane material reinforced by incorporating a fiber into the reinforced portion of the membrane material.

9. A method for installation of membrane material on a roof as in claim 3 in which said step of reinforcing said plurality of elongate members includes providing a reinforced portion of membrane material that is reinforced by adding a core material within the reinforced portion of the membrane material.

10. A method for installation of membrane material on a roof as in claim 3 in which said step of reinforcing said plurality of elongate members includes providing a reinforced portion of membrane material that is reinforced by adding synthetic polymers to the reinforced portion of the membrane material.

11. A method for installation of membrane material on a roof as in claim 10 in which said synthetic polymers include polyester bonded to a portion of reinforced portion of the membrane material.

12. A method for installation of membrane material on a roof as in claim 3 in which said step of reinforcing said plurality of elongate members includes providing a corded material.

13. A method for installation of membrane material on a roof as in claim 12 in which said corded material comprises a cable comprised of metal strands of wire.

14. A method for installation of membrane material on a roof as in claim 12 in which said corded material comprises rope.

15. A method for installation of membrane material on a roof as in claim 12 in which said corded material comprises a combination of cords incorporated into a reinforced portion of the membrane material.

16. A method for installation of membrane material on a roof as in claim 12 in which said corded material comprises a pre-fabricated membrane encasement with an interior cable, a lower strip of membrane material, an upper strip of membrane material, and a length of the interior cable centered within the strips of membrane material and encased therein with ends of the interior cable extended from ends of the membrane encasement for attachment to fastening points.

17. A method for installation of membrane material on a roof as in claim 12 in which said corded material comprises a membrane encasement with an interior cable and includes the additional step of forming the corded material by placing the interior cable onto the membrane material covering the roof substrate, placing an upper strip of membrane material over the interior cable and overlapping the membrane material covering the roof substrate with the upper strip and welding the upper strip to the membrane material on the roof substrate.

18. A method for installation of membrane material on a roof as in claim 12 in which said corded material comprises a membrane encasement with an interior cable and includes the additional step of forming the corded material by welding a lower strip of membrane material to the membrane material covering the roof substrate, placing the interior cable on the lower strip of membrane, placing an upper strip of membrane material over the interior cable and overlapping the lower strip of membrane material, and welding the upper strip to the lower strip using heat.

19. A method for installation of membrane material on a roof as in claim 3 in which said step of reinforcing said plurality of elongate members includes providing a reinforced portion of membrane material and the reinforced portion of membrane material includes an increased thickness of the membrane material compared to the membrane material covering the roof substrate and the reinforced portion of membrane material has a flat profile.

20. A method for installation of membrane material on a roof as in claim 3 in which said step of reinforcing said plurality of elongate members includes adding a core material through a modified membrane by insertion of the core material through a tubular section, channel, eyelets or elongate opening formed in the modified membrane.

* * * * *